US005398380A

United States Patent [19]

Leifeld

[11] Patent Number: 5,398,380

[45] Date of Patent: Mar. 21, 1995

[54] DRIVE SYSTEM FOR A CARDING MACHINE INCLUDING DOFFER ZONE DRAFT SETTING

[75] Inventor: Ferdinand Leifeld, Kempen, Germany

[73] Assignee: Trützschler GmbH & Co. KG, Monchen-Gladbach, Germany

[21] Appl. No.: 148,613

[22] Filed: Nov. 8, 1993

[30] Foreign Application Priority Data

Nov. 7, 1992 [DE] Germany ..... 42 37 671.8
Sep. 23, 1993 [DE] Germany ..... 43 32 329.4

[51] Int. Cl.[6] ..... D01G 15/10; D01G 15/64

[52] U.S. Cl. ..... 19/98; 19/106 R; 19/240

[58] Field of Search ..... 19/98, 99, 105, 106 R, 19/236, 239, 240

[56] References Cited

U.S. PATENT DOCUMENTS

| | | | |
|---|---|---|---|
| 3,977,046 | 8/1976 | Wise | 19/240 |
| 4,075,739 | 2/1978 | Staheli | 19/240 |
| 4,271,565 | 6/1981 | Grunder | 19/240 |
| 4,438,548 | 3/1984 | Grunder | 19/240 X |
| 4,779,310 | 10/1988 | Leifeld | 19/105 |
| 4,982,477 | 1/1991 | Hosel | 19/239 X |
| 5,152,033 | 10/1992 | White | 19/105 |

FOREIGN PATENT DOCUMENTS

| | | |
|---|---|---|
| 235093 | 9/1987 | European Pat. Off. . |
| 2650287 | 11/1984 | Germany . |
| 3507242 | 11/1985 | Germany . |
| 3821238 | 12/1989 | Germany . |
| 1393775 | 5/1975 | United Kingdom . |
| 1537531 | 12/1978 | United Kingdom . |
| 2062037 | 5/1981 | United Kingdom . |
| 2221699 | 2/1990 | United Kingdom . |
| 1534111 | 1/1990 | U.S.S.R. . |

OTHER PUBLICATIONS

Hans Ebert, "Moderne Einzelantriebe an Wanderdeckelkarden", Z. ges. Textilind. 60 (1958), No. 20, Oct. Issue 2, pp. 903–905.

*Primary Examiner*—Clifford D. Crowder
*Assistant Examiner*—Ismael Izaguirre
*Attorney, Agent, or Firm*—Spencer, Frank & Schneider

[57] ABSTRACT

A carding machine includes a plurality of rotary fiber processing rolls arranged in succession as viewed in a direction of fiber advance through the carding machine. The output speed of the carding machine is varied by varying the rpm of one of the fiber processing rolls. The carding machine has a doffer zone containing some of the fiber processing rolls. A first electromotor is connected to a first fiber processing roll in the doffer zone and a first control and regulating unit is connected to the first electromotor. Further, a second electromotor is connected to a second fiber processing roll in the doffer zone and a second control and regulating unit is connected to the second electromotor. There is further provided a draft setting device connected to the first and second control and regulating units for automatically varying a ratio between the rpm of the first fiber processing roll and the rpm of the second fiber processing roll for automatically varying a draft when the output speed of the carding machine is altered.

13 Claims, 10 Drawing Sheets

13
1
2
3
4
5
6
7
8
9
10
11
12
14
15
16
17
18
19
20
21
22
23
24
26
38
39
40

| | OUTPUT SPEED m/min | | DRAFT FACTOR |
|---|---|---|---|
| | 250 | 10 | |
| CALENDER ROLL RPM | 1100 | 44 | 25 |
| DOFFER RPM | 90 | 10 | 8 |

DRIVE SYSTEM FOR A CARDING MACHINE INCLUDING DOFFER ZONE DRAFT SETTING

CROSS REFERENCE TO RELATED APPLICATION

This application claims the priority of German Application No. P 42 37 671.8 filed Nov. 7, 1992, which is incorporated herein by reference.

BACKGROUND OF THE INVENTION

This invention relates to a drive system for a carding machine for processing textile fibers such as cotton or synthetic fibers and is of the type in which the fiber processing rolls situated in the zone of the doffer are driven by an electromotor coupled to an electronic motor control and regulating unit including desired value setters. A change of the output speed is effected, for example, by changing the rpm of the electromotor. The drive system is further of the type in which the draft (that is, the longitudinal tensioning force imparted on the running, coherent fiber material) is adjustable.

In an apparatus of the above-outlined type, disclosed, for example, in German Offenlegungsschrift (application published without examination) 29 44 428, the doffer is associated with a first motor control which includes an electronic tachogenerator, an electronic motor regulator and a variable speed motor which drives the doffer as well as the rolls which are situated in the doffer zone. The electronic motor regulator comprises an rpm regulator with a subordinated current regulator. A desired value setter (such as a potentiometer) for the output speed which corresponds, for example, to the rpm of the doffer, is connected with the electronic motor regulator with the intermediary of a desired value preselector. The first motor regulator for the doffer is connected by means of an electric shaft with a second motor control for the feed roller at the input of the carding machine. The second motor control includes an electronic tachogenerator operatively coupled to the feed roller, an electronic motor regulator and a speed variable motor driving the feed roller. A desired value setter for the feed roller (such as a potentiometer) for setting the draft, is coupled with the electronic motor regulator with the intermediary of a desired value preselector.

The electronic tachogenerator and the electronic motor regulator for the doffer are connected via a desired value preselector for the feed roller with the electronic motor regulator for the feed roller (electric shaft).

The output speed (for example, 150 m/min) equals the circumferential speed of the calender rolls behind the sliver trumpet or in the sliver coiler and is determined by the rpm of, for example, the doffer. The draft (for example, one hundredfold) equals the ratio of the circumferential speed of the calender rolls to the circumferential speed of the feed roll. The total draft is determined in the German Industrial Standard DIN 64080.

The total draft is composed of the product of several individual drafts, for example, of the draft between the calender roll pair and the doffer and the draft between the doffer and the feed roller.

In the known system in case of a new setting (for example, when a batch change occurs) a certain total draft, for example 100%, is set which is maintained during operation. For this purpose the potentiometer is used which is connected to the electronic motor regulator for the feed roller. At the same time, all individual drafts, for example, the draft between the calender rolls and the crushing rolls (for example 23%) are set which also remain constant during operation. In contrast to the draft, the output speed may change during operation. It ranges from the high peak velocity during production through the lesser velocity during the run-up or run-down phase down to the low delivery speed during the beginning phase of the fiber thread-in operation. During such a change of the output speed the initially set draft remains constant. Stated differently, even if the output speed changes, the draft—either the total draft or the individual drafts—remains constant. The feed roller and the doffer are connected to one another by an electric shaft and rotate synchronously at a certain ratio relative to one another.

To obtain high output speeds for achieving a high production rate, large drafts are required. If such large drafts are preserved even at low output speeds (for example, during the thread-in operation), the fiber web is ruptured on the rolls during the low output speed because the drafts for such a speed range is excessive. Such problems become increasingly more serious as the difference between the starting speed and the final speed of the card increases. This problem limits the peak velocity of the card and thus also limits the peak output rate.

SUMMARY OF THE INVENTION

It is an object of the invention to provide an improved drive system of the above-outlined type from which the discussed disadvantages are eliminated and which, in particular, makes possible a high output speed without causing tear or rupture of the fiber material on the rolls during the periodic lower output rate prevailing during the thread-in, run-up, run-down or alternating run.

This object and others to become apparent as the specification progresses, are accomplished by the invention, according to which, briefly stated, the carding machine includes a plurality of rotary fiber processing rolls arranged in succession as viewed in a direction of fiber advance through the carding machine. The output speed of the carding machine is varied by varying the rpm of one of the fiber processing rolls. The carding machine has a doffer zone containing some of the fiber processing rolls. A first electromotor is connected to a first fiber processing roll in the doffer zone and a first control and regulating unit is connected to the first electromotor. Further, a second electromotor is connected to a second fiber processing roll in the doffer zone and a second control and regulating unit is connected to the second electromotor. There is further provided a draft setting device connected to the first and second control and regulating units for automatically varying a ratio between the rpm of the first fiber processing roll and the rpm of the second fiber processing roll for automatically varying a draft when the output speed of the carding machine is altered.

By virtue of the measures according to the invention, an automatic alteration of the drafts is achieved for different output speeds. The drafts are changed automatically in different zones of the carding machine between the calender rolls and the doffer according to particular characteristic curves as a function of the delivery speed. In this manner, in the range of low output speeds, low drafts—for example 15%—and at high output speeds, for example, 300 m/min and above, higher drafts—for example, 55%—are obtained. Thus, the large drafts required for high outputs are reduced for the lower output speeds so that rupture in the fiber material at low output speeds will not occur. In particular, the peak velocity of the machine and thus the peak output is increased even when the starting speed of the machine is substantially different from the terminal speed. The increase in the output speed is thus made possible by adapting the draft during the rpm change for the different values between starting and peak speeds.

Expediently, the doffer and the stripping roll are driven by a common electromotor and the crushing rolls as well as the calender rolls are driven by an additional, common electromotor. In this manner the fiber material on the rolls is not adversely affected in the critical zone on the stripping roll and will thus is not tear. Preferably, the additional electromotor drives the calender rolls associated with the sliver coiler. Expediently, the tachogenerator is connected with an electric control and regulating device, such as a microcomputer, which, upon a change in the roll velocity of one roll or roll pair, sets a changed rpm for the one or the other electromotor associated with the doffer zone.

According to an alternative solution, the rolls or roll pairs of the doffer zone of the carding machine are driven by an electromotor by means of a steplessly variable drive and the tachogenerator which is associated with the electromotor is connected with a draft setting device which, upon change of the roll speed automatically sets—according to the signals of the tachogenerator—a changed draft between the separately driven rolls or roll pairs. The drive is expediently associated with a servomotor for effecting the adjustment.

DESCRIPTION OF THE PREFERRED EMBODIMENTS

Figure 1A:
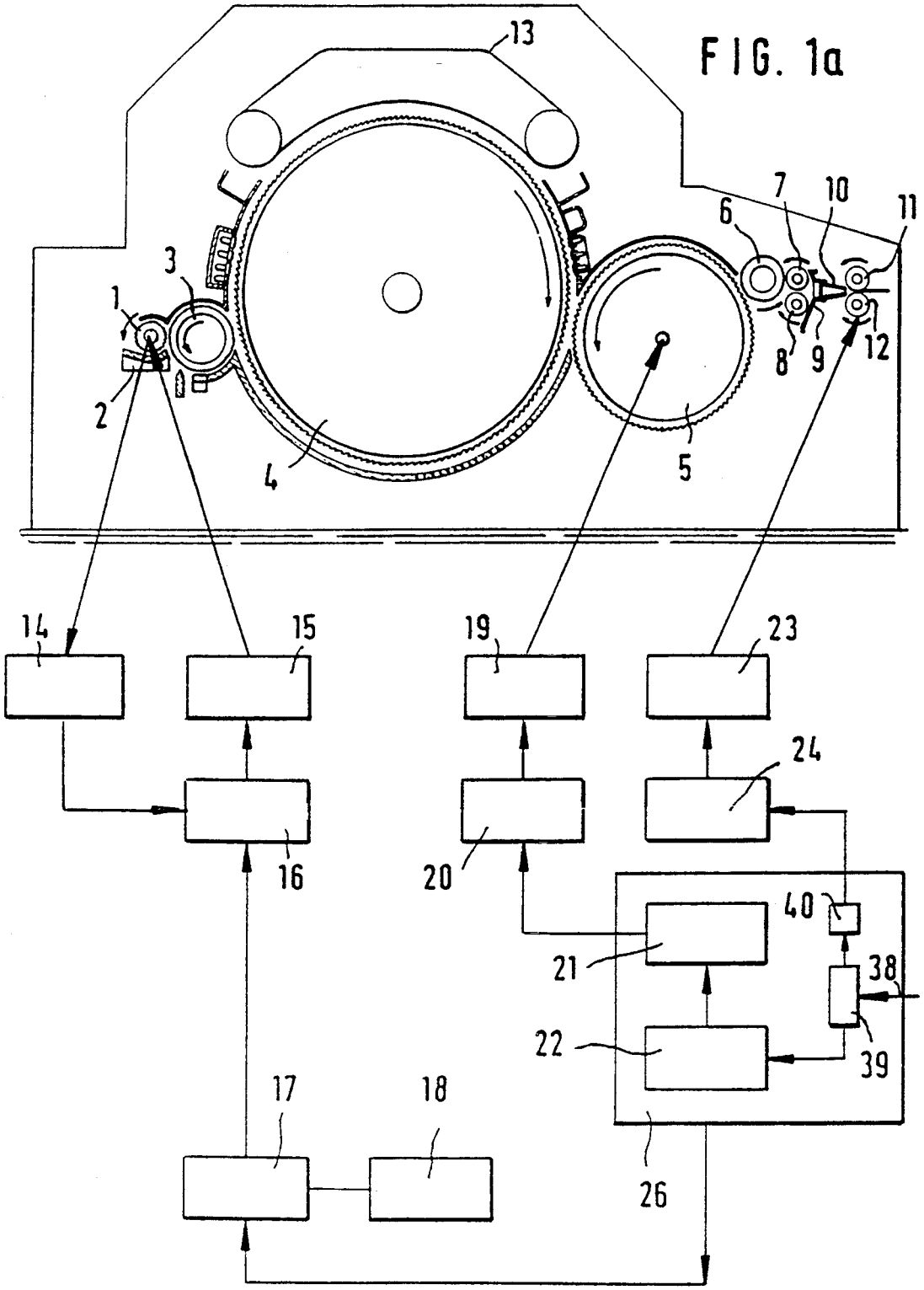
FIG. 1*a* is a schematic side elevational view of a carding machine, with block diagram, incorporating the invention.
Figure 1B:
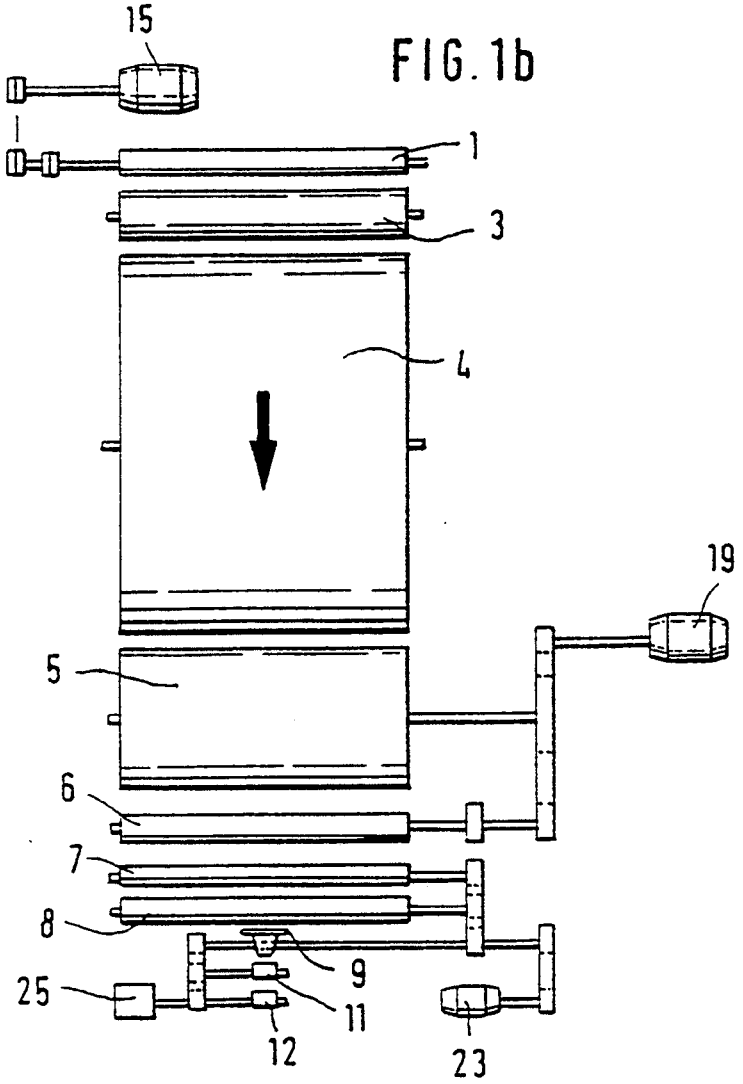
FIG. 1*b* is a schematic top plan view of one part of the carding machine shown in FIG. 1*a*.

Turning to FIGS. 1*a* and 1*b*, there is shown therein a carding machine which may be, for example, an EXACTACARD DK 760 model manufactured by Trützschler GmbH & Co. KG, Mönchengladbach, Germany. The carding machine has a feed roller 1, a feed plate 2 cooperating therewith, a licker-in 3, a main carding cylinder 4, a doffer 5 (having a diameter of, e.g. 700 mm), a stripping roll 6, crushing rolls 7 and 8, a web guide element 9, a sliver trumpet 10, calender rolls 11 and 12 (each having a diameter of, e.g. 150 mm) as well as travelling flats 13. The feed roller 1 is driven by an electric motor 15 controlled by an electric motor regulator 16 to which signals of a tachogenerator 14 are applied which detects the rpm of the feed roller 1. The motor regulator 16 is connected with a desired value preselector 17 controlled by a potentiometer 18.

A control and regulating unit 24 is coupled to a drive motor 23 which rotates the calender rolls 11 and 12 and to a microcomputer 26 of an electric control and regulating device. The latter also controls a drive motor 19 of the doffer 5 with the intermediary of a control and regulating unit 20.

The motor control and regulating units 20 and 24 have a dual function: by virtue of the control function, a predetermined rpm, for example, 100 is preset for the doffer 5. The regulating function ensures that the predetermined rpm, such as 100, remains constant.

Figure 2:
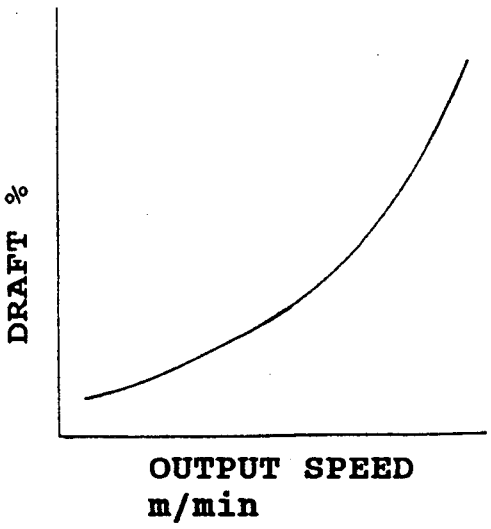
FIG. 2 is a diagram illustrating the draft as a function of the output speed.
Figure 3:
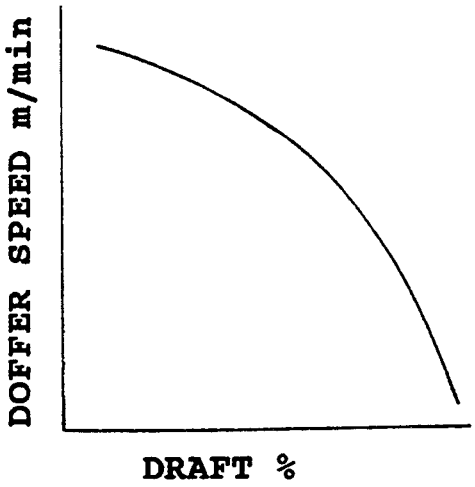
FIG. 3 is a diagram illustrating the doffer velocity as a function of the draft.

With particular reference to FIG. 1*b*, the doffer 5 and the stripping roll 6 are directly driven by the drive motor 19, while the drive motor 23 rotates the crushing rolls 7 and 8 as well as the calender rolls 11 and 12. The information (signal 38) received by the microcomputer 26 is applied to a computer component 39 (memory) in which output speed values (for example, for the thread-in phase and the normal production phase) are stored. The component 39 is connected with a device 40 for determining the rpm's of the calender rolls 11, 12. The device 39 is furthermore connected with a draft evaluating device 22 which evaluates the output speed as shown in the graph illustrated in FIG. 2. By comparing with empirically determined curves, the optimal draft range belonging to the output speed is determined and the resulting new rpm for the doffer 5 is computed in the speed determining stage 21, as illustrated in the graph of FIG. 3.

Figure 4:
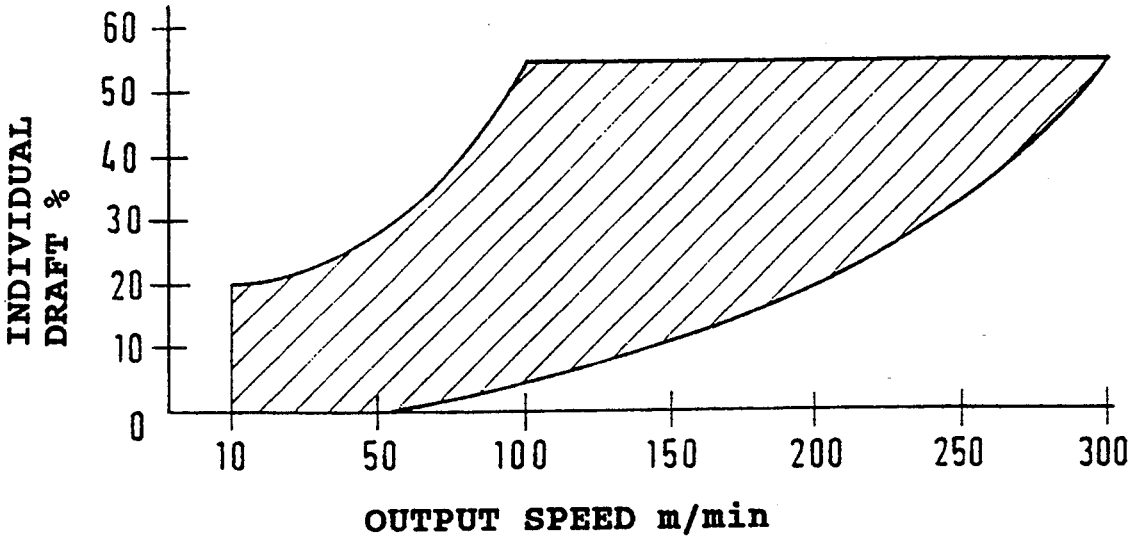
FIG. 4 is a diagram illustrating the individual drafts as a function of the output speed.

In FIG. 4, the shaded area illustrates the zone in which a disturbance-free operation with different output speeds and corresponding drafts (individual draft in the zone between the calender rolls and doffer) is possible.

Figure 5:
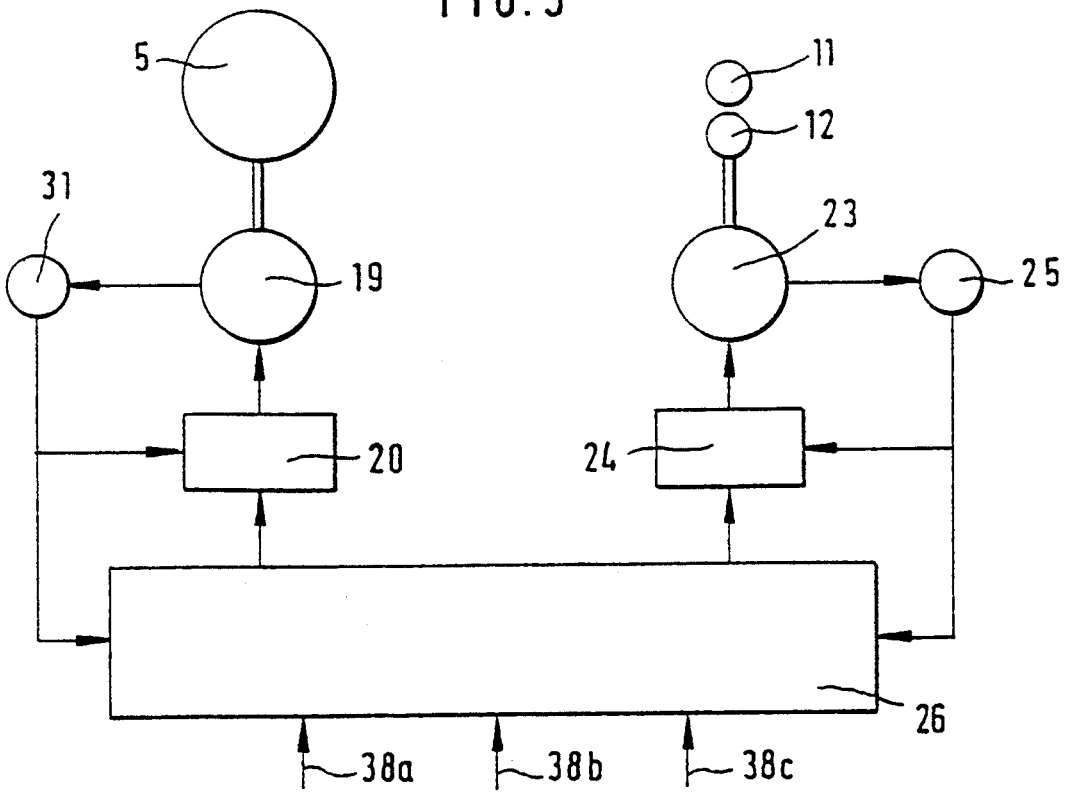
FIG. 5 is a block diagram illustrating an rpm control for the doffer.

The block diagram of FIG. 5 illustrates the control of the doffer 5. The electromotor 23 drives the lower calender roll 12 and is coupled with the tachogenerator 25 which, in turn, is connected to the control and regulating unit 24 and the microprocessor 26. The unit 24 ensures a regulation of the motor 23 to maintain the rpm constant during normal operation. Similar considerations apply to the tachogenerator 31 which is connected with the drive motor 19 of the doffer 5 through the control and regulating unit 20. The tachogenerator 25, however, has as additional, more significant function: it performs a dual function since, as described earlier, it applies values to the microcomputer 26 which are evaluated therein and are applied to the drive motor 19 of the doffer 5 via the unit 20 to adjust the draft by changing the rpm.

The signals 38*a*, 38*b* and 38*c* may be generated by additional (not illustrated) signal transmitters, for example, for the termination of the coiler can replacement process.

Figures 6A, 6B:
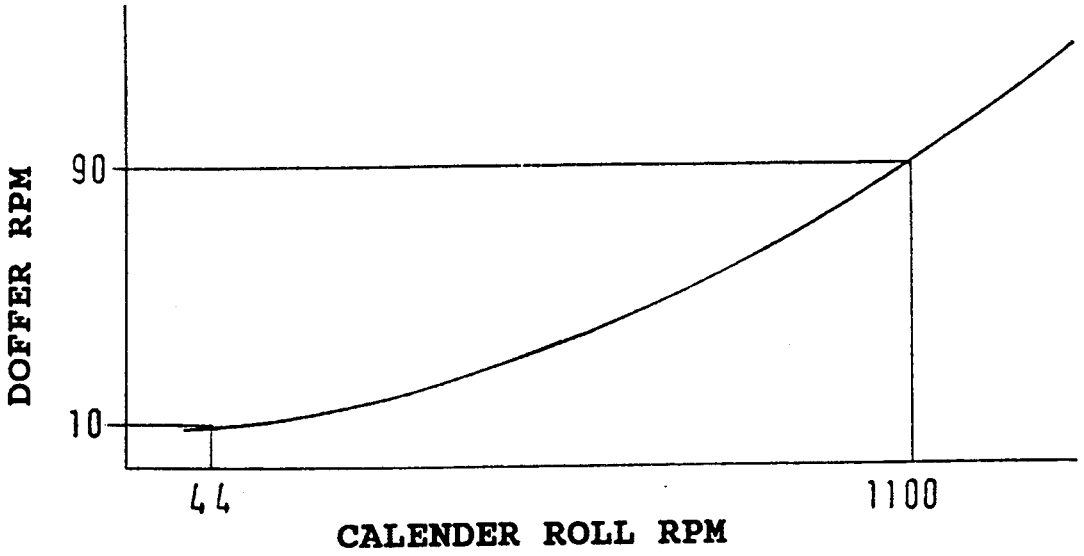
FIG. 6*a* is a diagram illustrating the doffer rpm as a function of the calender roll rpm.
FIG. 6*b* represents the data of FIG. 6*a* in table form.

Turning to FIGS. 6*a* and 6*b* there is shown therein a curve and, respectively, table values for two speeds, that is, for the thread-in speed (10 m/min) and for the normal output speed (250 m/min). If thus the output speed is reduced to the speed required for the thread-in process, the microcomputer 26, by means of rpm adaptation, automatically assigns the appropriate draft to such a speed.

Instead of controlling the draft at one location, it is feasible to provide the rolls, which heretofore had fixed transmission ratios, with individual drive motors and thus to control the draft variation at more than one location. Such possibilities are illustrated in FIGS. 8–12.

Figure 7:
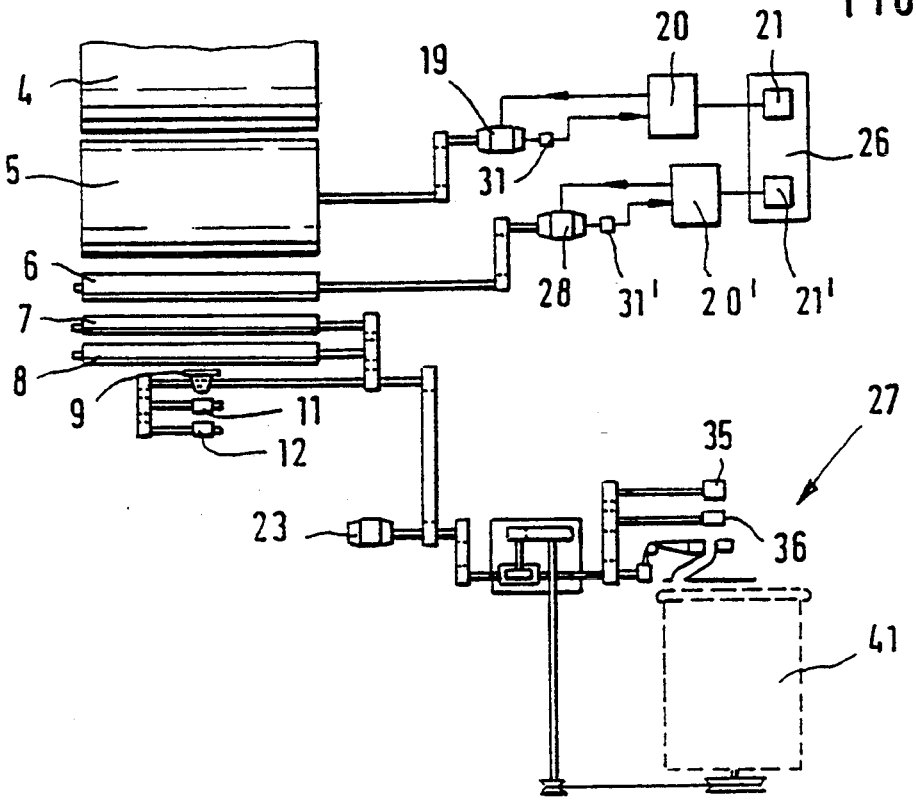
FIGS. 7–12 are schematic top plan views of various arrangements for controlling the doffer, the stripping roll, the calender rolls and the crushing rolls in a carding machine.

Thus, in FIG. 7 there is shown a separate regulation for the stripping roll 6 driven by the motor 28. Tachogenerators 31 and 31' are associated with the respective motors 28 and 19. The tachogenerators 31 and 31' may serve for regulation as well as control.

Figure 8:
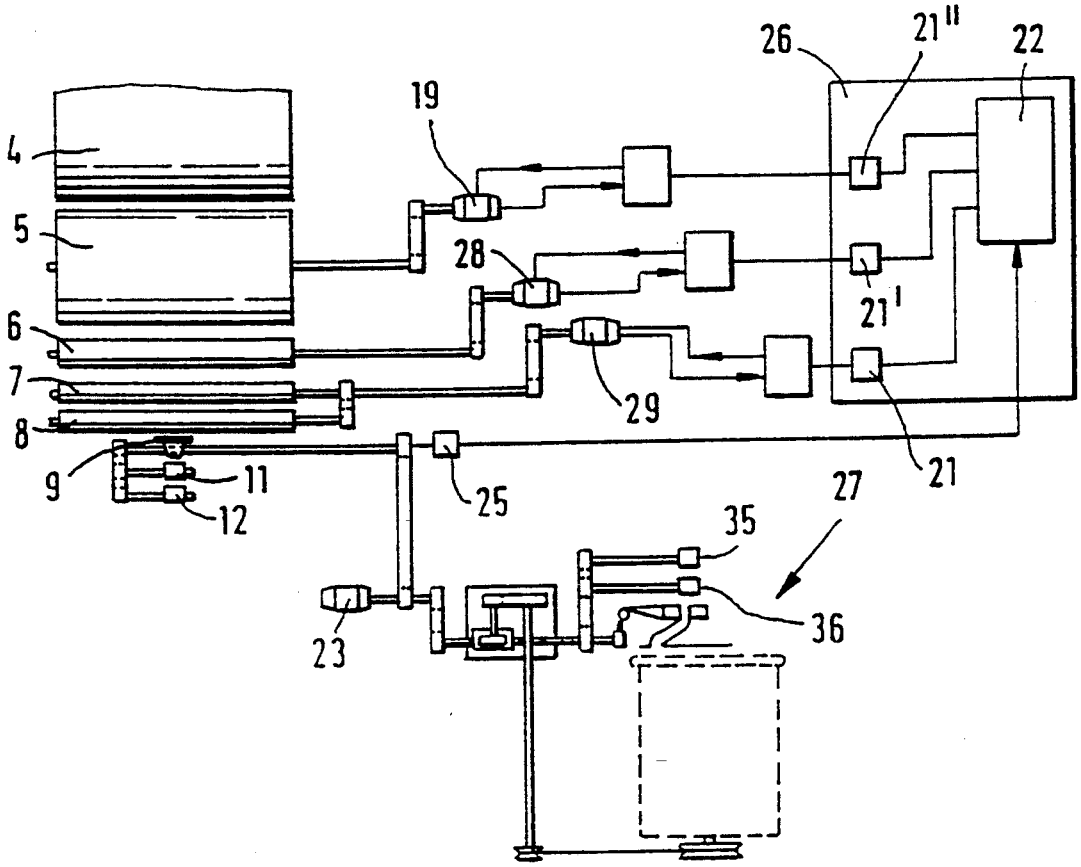
Figure 9:
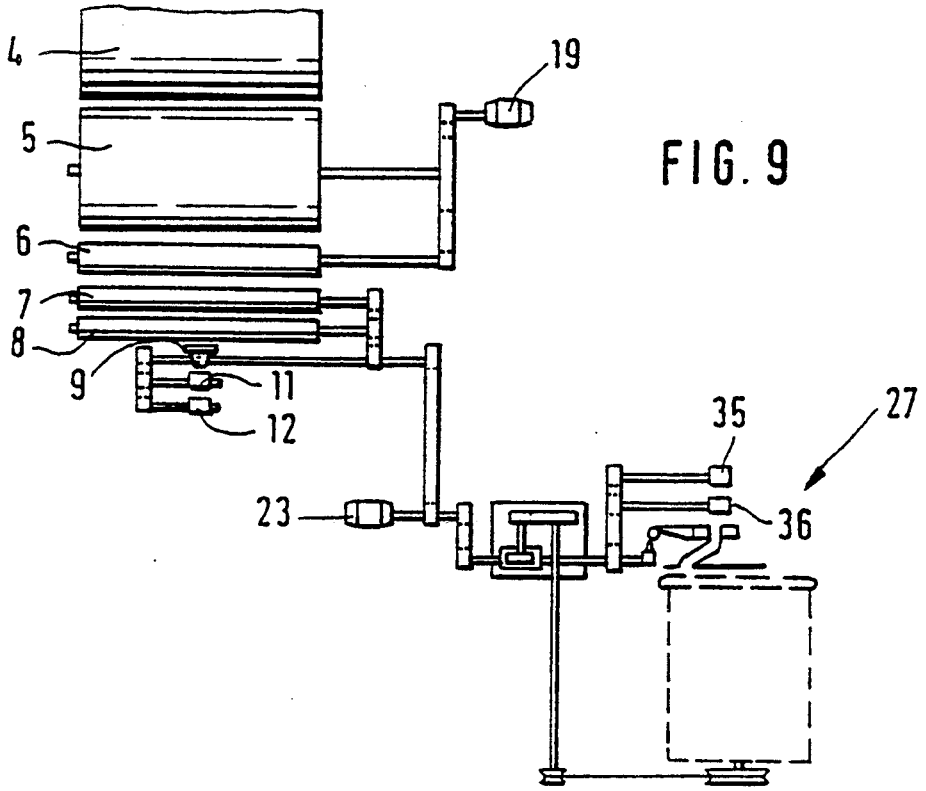

The system according to FIG. 8 is additionally divided. In this arrangement the crushing rolls too, that is, the upper crushing roll 7 and the lower crushing roll 8 may be separately driven and regulated. According to FIG. 9, the doffer 5 and the stripping roll 6 are driven by a common motor 19; these rolls thus operate with a fixed draft relative to one another. The roll pairs of the crushing rolls 7, 8 and the calender rolls 11 and 12 are similarly combined. The draft adaptation may thus be effected between these two separately driven components.

Figure 10:
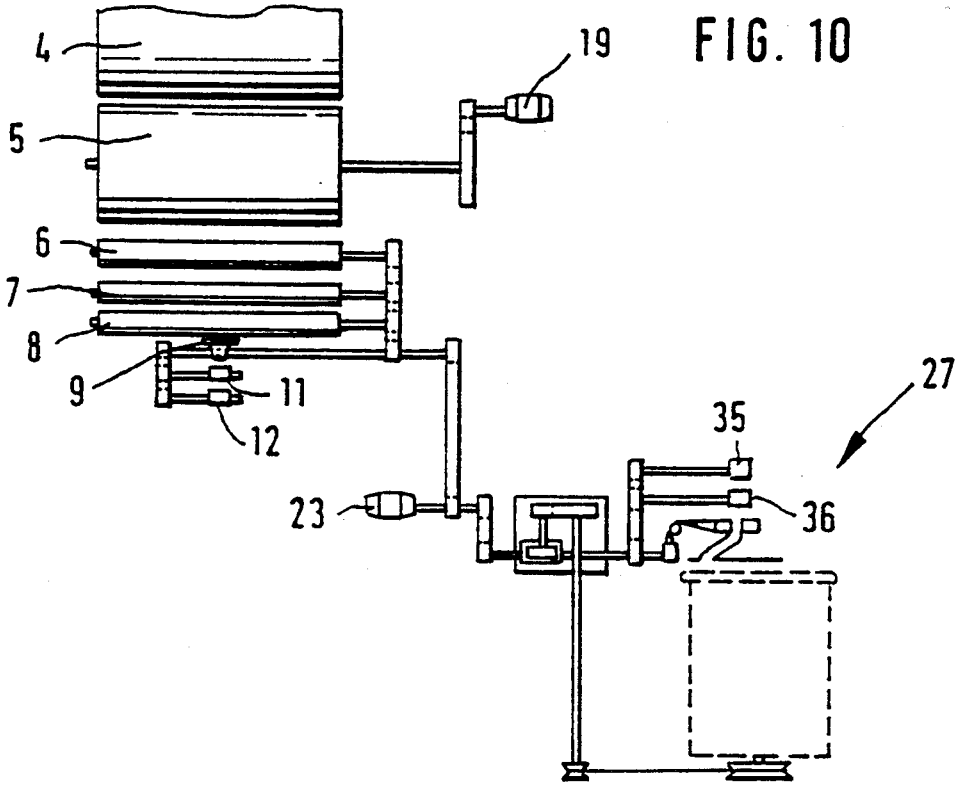
Figure 11:
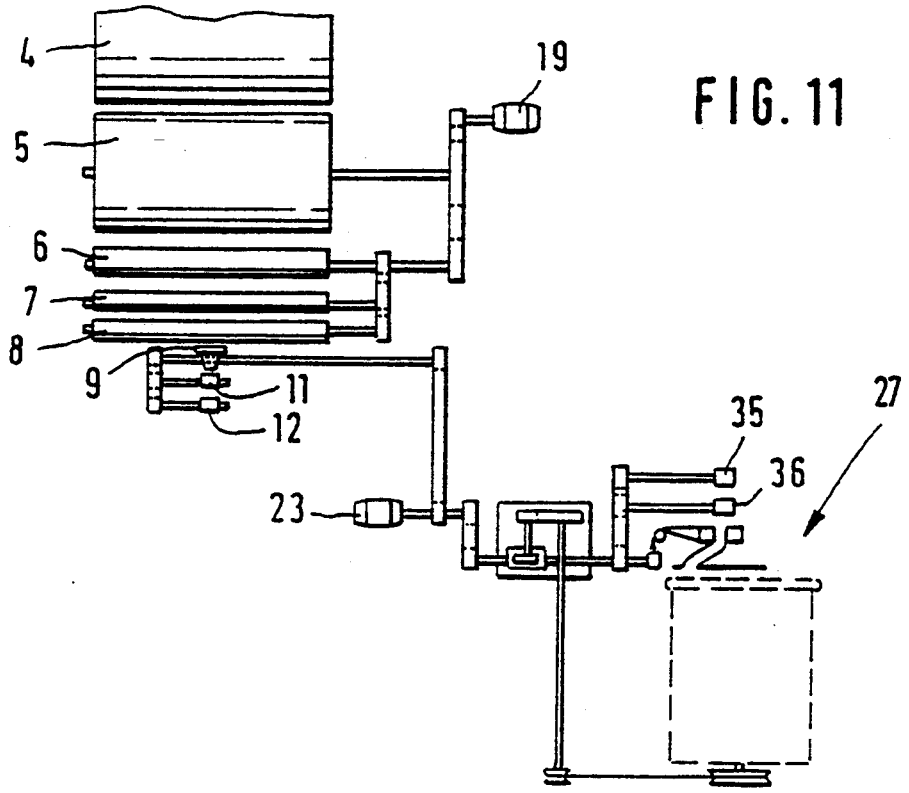

In FIG. 10 the individual drive for the doffer 5 by means of the motor 19 and a combined grouping of all rolls downstream thereof are illustrated. The desired draft adaptation is effected in this arrangement between the doffer 5 and the stripping roll 6. In a similar manner there is obtained the adjustability of the draft according to FIG. 11 between the two roll pairs, that is, the crushing rolls 7, 8 and the calender rolls 11, 12.

It is common to all the arrangements depicted in FIGS. 7–12 that they include additionally the sliver coiler 27 with coil depositing rolls 35, 36.

Figure 12:
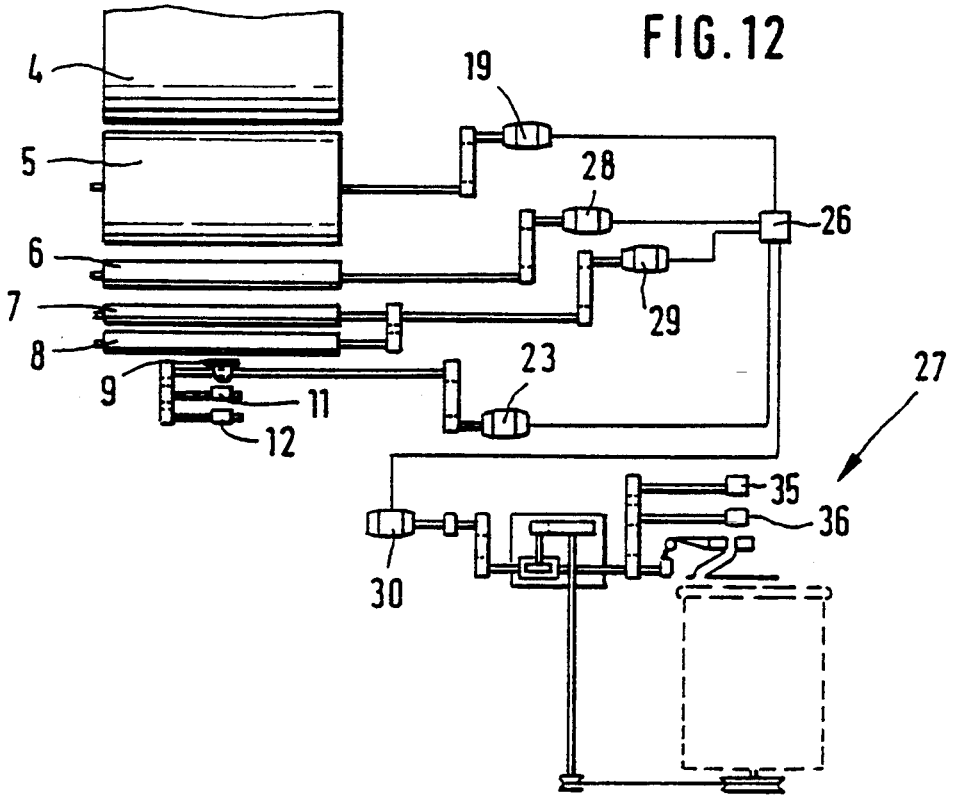

In a further division as shown in FIG. 12, an additional draft may be effected between the calender rolls 11, 12 on the one hand and the coil depositing rolls 35, 36 on the other hand. For this purpose, the drive motor 30 of the sliver coiler 27 has to be connected with the microcomputer 26 similarly to the other motors, that is, the drive motor 23 for the calender rolls 11, 12, the drive motor 29 for the crushing rolls 7, 8, the drive motor 28 for the stripping roll 6 and the drive motor 19 for the doffer 5.

Figure 13A:
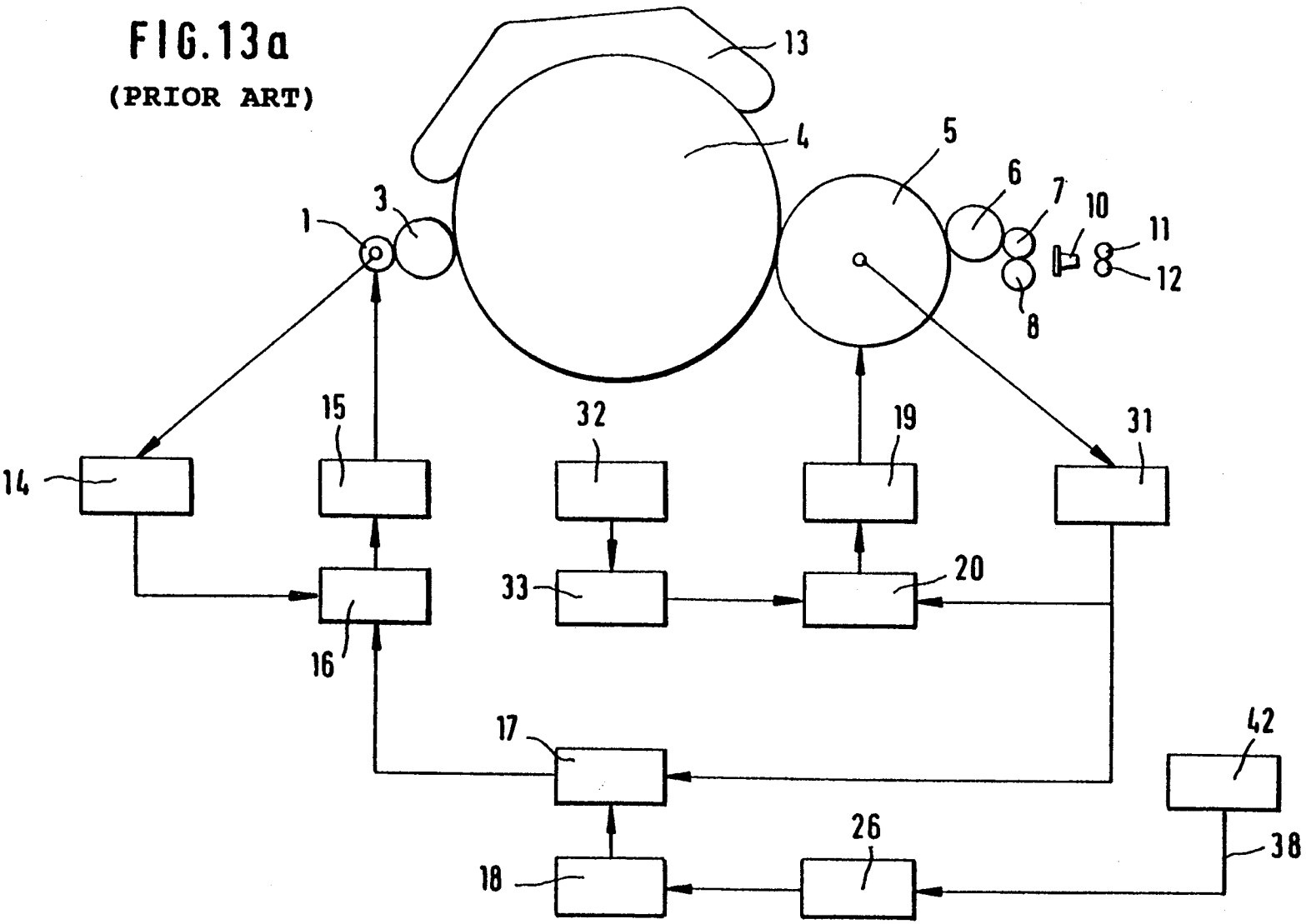
FIG.13a (PRIOR ART)
FIG. 13*a* is a schematic side elevational view of a carding machine with block diagram, illustrating a machine control according to the prior art.
Figure 13B:
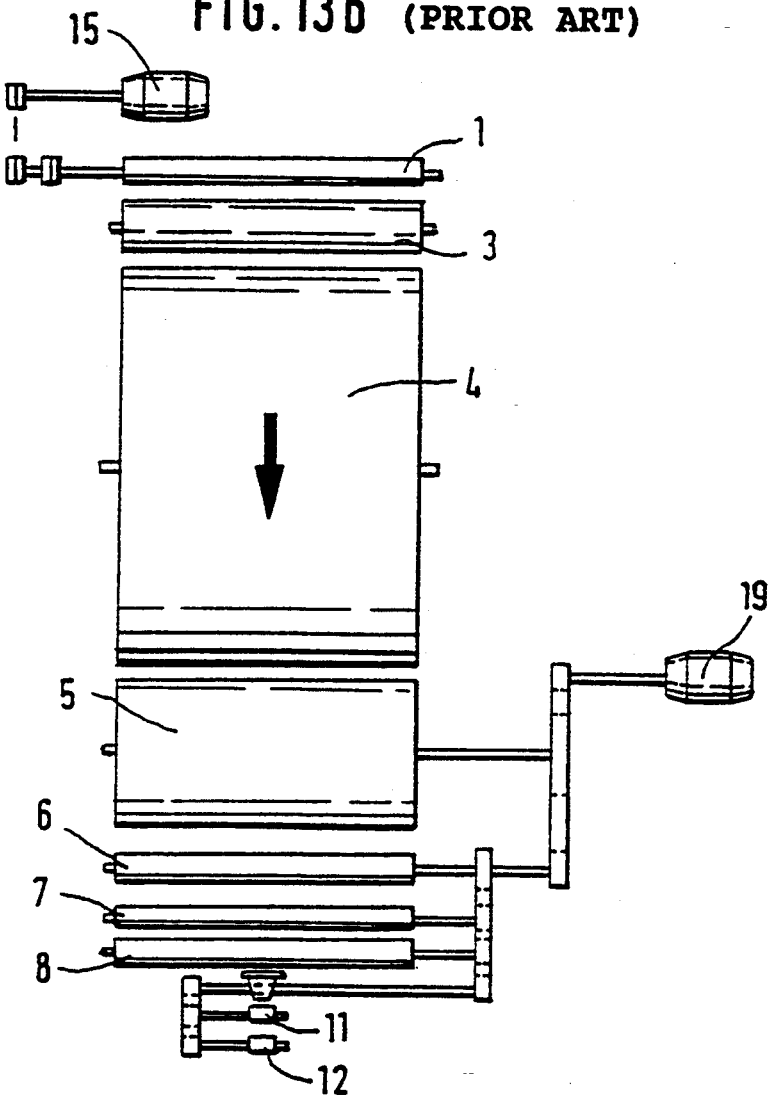
FIG. 13b (PRIOR ART)
FIG. 13*b* is a schematic top plan view of one part of a carding machine controlled according to the prior art.
Figure 13C:
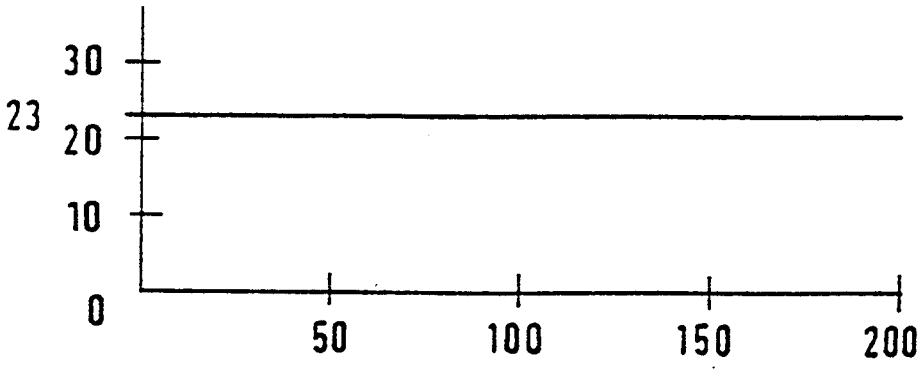
FIG. 13c (PRIOR ART)
FIG. 13*c* is a diagram illustrating the individual drafts (in percentages) as a function of the output speed according to the prior art control.

FIGS. 13*a*, 13*b* and 13*c* illustrate the prior art which includes a number of components also present in the construction according to the invention. Thus, the electronic tachogenerator 14 associated with the feed roller 1 conventionally serves for the rpm regulation of the drive motor 15 of the feed roller 1 in conjunction with the motor regulator 16. Similarly, the tachogenerator 31 serves for the rpm regulation of the drive motor 19 of the doffer 5 via the motor regulator 20. It has been also feasible in prior art constructions to set a certain rpm for the feed roller 1 and the doffer 5 by the desired value setter 32 and the desired value preselector 33 as well as the desired value setter 18 and the desired value preselector 17. A signal transmitter 42, which may be a measuring element to determine the fill level in the coiler can 41, emits a signal 38 for setting, for example, the thread-in process. In the prior art arrangement, however, once the draft has been set, for example, to a value between 23 and 34% in the region between the calender rolls 11, 12 and the doffer 5, it remained constant for all output speeds because of the rigid coupling between the doffer 5 and the subsequent rolls 6; 7, 8; as well as 11, 12.

Figure 14:
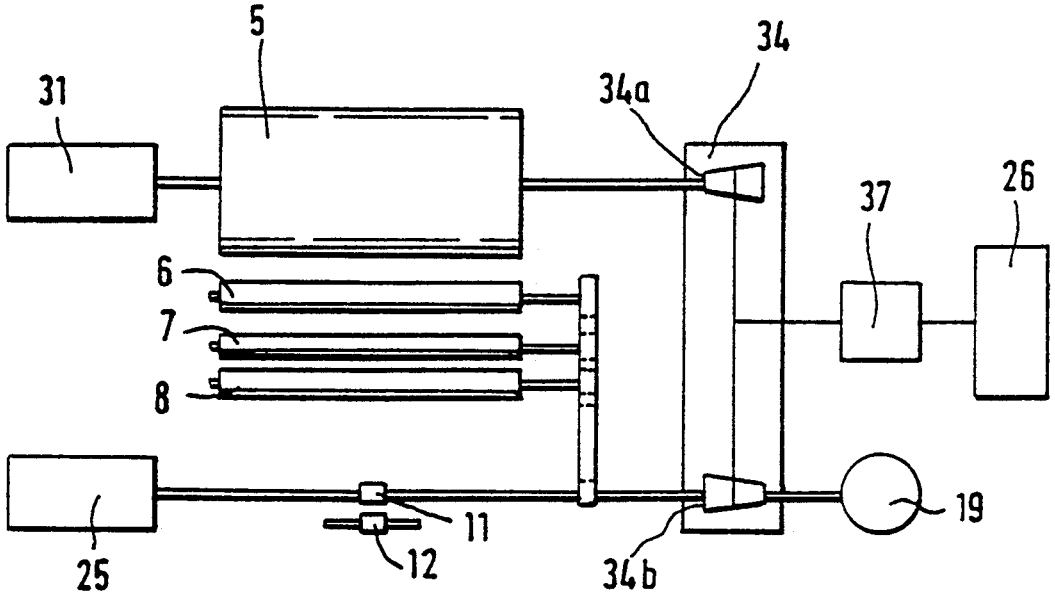
FIG. 14 is a schematic top plan view including a roll drive with a stepless regulating drive according to the invention.

FIG. 14 illustrates an alternative solution for the draft adjustment between the doffer 5 and the stripping roll 6. In this arrangement, instead of a separate motor, there is provided a stepless drive (gearing) 34 between the calender roll pair 11, 12 and the doffer 5. One output 34*a* of the drive 34 is coupled to the doffer 5, while another output 34*b* is coupled to the calender roll pair 11, 12. The control is effected by the microcomputer 26 via a setting member 37, for example, a servomotor, by means of which the rpm of one of the shafts coupled to the gearing 34 is altered and thereby the draft is adapted to the output speed.

It will be understood that the above description of the present invention is susceptible to various modifications, changes and adaptations, and the same are intended to be comprehended within the meaning and range of equivalents of the appended claims.

What is claimed is:

1. In a carding machine including a plurality of rotary fiber processing rolls arranged in succession as viewed in a direction of fiber advance through the carding machine; means for varying an output speed of the carding machine by varying the rpm of one of said fiber processing rolls; the carding machine having a doffer zone containing some of the fiber processing rolls; the improvement comprising (a) a first electromotor connected to at least one first of said fiber processing rolls in said doffer zone for rotating said at least one first fiber processing roll;

(b) a first control and regulating unit connected to said first electromotor;

(c) a second electromotor connected to at least one second of said fiber processing rolls in said doffer zone for rotating said at least one second fiber processing roll;

(d) a second control and regulating unit connected to said second electromotor; and (e) a draft setting device connected to said first and second control and regulating units for automatically varying a ratio between the rpm of said at least one first fiber processing roll and the rpm of said at least one second fiber processing roll for automatically varying a draft when said means for varying said output speed alters the output speed of the carding machine.

2. The carding machine as defined in claim 1, wherein the fiber processing rolls in the doffer zone include a doffer, a stripping roll, a crushing roll pair and a calender roll pair; further wherein said doffer and said stripping roll are the first fiber processing rolls and said crushing roll pair and said calender roll pair are said second fiber processing rolls.

3. The carding machine as defined in claim 1, further comprising a sliver coiler including a sliver coil depositing roll pair; said second electromotor being connected to said sliver coil depositing roll pair.

4. The carding machine as defined in claim 1, further comprising a sliver coiler including a sliver coil depositing roll pair; and a third electromotor drivingly connected to said sliver coil depositing roll pair.

5. The carding machine as defined in claim 1, further comprising a control and regulating device including said draft setting device; and a tachogenerator connected with said control and regulating device and sensing the rpm of said one fiber processing roll.

6. The carding machine as defined in claim 5, wherein said control and regulating device comprises a memory for receiving data representing said difference as a function of rpm detected by said tachogenerator.

7. The carding machine as defined in claim 5, wherein the fiber processing rolls in the doffer zone include a doffer, a stripping roll, a crushing roll pair and a calender roll pair; and further wherein said doffer and said stripping roll are the first fiber processing rolls and said crushing roll pair and said calender roll pair are the second fiber processing rolls; further wherein said tachogenerator is connected with said second electromotor.

8. The carding machine as defined in claim 5, further wherein said control and regulating device comprises a signal transmitter connected to said means for varying the output speed.

9. The carding machine as defined in claim 8, wherein said control and regulating device comprises a memory for storing therein output speed values; said memory being connected to said signal transmitter and said means for varying the output speed.

10. The carding machine as defined in claim 8, further comprising a sliver coiler including a coiler can; said signal transmitter being a fill lever measuring device for the coiler can.

11. The carding machine as defined in claim 8, wherein said signal transmitter is operatively connected to said first electromotor.

12. In a carding machine including a plurality of rotary fiber processing rolls arranged in succession as viewed in a direction of fiber advance through the carding machine; means for varying an output speed of the carding machine by varying the rpm of one of said fiber processing rolls; the carding machine having a doffer zone containing some of the fiber processing rolls; the improvement comprising (a) an electromotor;

(b) a steplessly variable transmission having an input connected to said electromotor, a first output connected to a first of said fiber processing rolls of the doffer zone and a second output connected to a second of said fiber processing rolls of the doffer zone;

(c) a tachogenerator operatively connected to at least one of said first and second fiber processing rolls to detect the rpm thereof; and (d) a draft setting device connected to said tachogenerator and to said first and second fiber processing rolls for automatically varying a ratio between the rpm of said first output and the rpm of said second output for automatically varying a draft between said first and second fiber processing rolls when said means for varying said output speed alters the output speed of the carding machine.

13. The carding machine as defined in claim 12, further comprising a servomotor connected to said draft setting device and said steplessly variable transmission for varying the rpm of said first and second outputs thereof.

* * * * *